United States Patent [19]

Thalenfeld

[11] Patent Number: 4,471,512

[45] Date of Patent: Sep. 18, 1984

[54] FRICTION CLIP FOR MERCHANDISE DISPLAY HOOKS AND THE LIKE

[75] Inventor: David R. Thalenfeld, Beachurst, N.Y.

[73] Assignee: Trion Industries Inc., Wilkes-Barre, Pa.

[21] Appl. No.: 508,419

[22] Filed: Jun. 27, 1983

Related U.S. Application Data

[63] Continuation of Ser. No. 298,636, Sep. 2, 1981, abandoned.

[51] Int. Cl.[3] ..... A44B 21/00

[52] U.S. Cl. ..... 24/557; 24/561

[58] Field of Search ..... 24/257 R, 249 R, 255 R, 24/254, 256, 138 R, 255 BS

[56] References Cited

U.S. PATENT DOCUMENTS

| | | | |
|---|---|---|---|
| 1,868,726 | 7/1932 | Collier . | |
| 1,928,536 | 9/1933 | Heinlen et al. | 24/255 R |
| 2,002,001 | 5/1935 | Beard | 24/255 R X |
| 2,626,061 | 1/1953 | Girouard | 211/59 |
| 2,783,515 | 3/1957 | Tobias | 24/255 R |
| 3,043,902 | 7/1962 | Klein | 174/146 |
| 3,204,313 | 9/1965 | See | 24/137 |
| 3,257,695 | 6/1966 | Frame | 24/138 R X |
| 3,353,567 | 11/1967 | Isreeli | 138/106 |
| 3,468,318 | 9/1969 | Cook et al. | 24/257 R X |
| 4,217,986 | 8/1980 | Brown | 211/57.1 |

FOREIGN PATENT DOCUMENTS

| | | | |
|---|---|---|---|
| 437225 | 6/1948 | Italy . | |
| 643244 | 9/1950 | United Kingdom | 24/138 R |

*Primary Examiner*—Mickey Yu

*Attorney, Agent, or Firm*—Mandeville and Schweitzer

[57] ABSTRACT

The disclosure relates to a resilient friction clip adapted to be received over and to frictionally grip the wire portion of a merchandise display hook, such as used pegboard displays. The clip is formed of resilient material, of extruded, or more preferably molded construction. A center aperture is provided for gripping the wire, and a radial slit extends from the periphery of the clip into the center aperture, enabling the clip to be forcibly applied over the wire. A pair of angularly disposed manipulating tabs are formed integrally on the clip, opposite to and symmetrical with the radial slit. The manipulating tabs may be gripped by the fingers and squeezed together, to open the radial slit and greatly facilitate application of the clip onto the wire. Squeezing of the manipulating tab also tends to release the friction grip of the clip on the wire for easy adjustment of its position. At the same time, squeezing of the tabs does not facilitate unauthorized removal of the clip, in that the center aperture does not open to the diameter of the wire.

2 Claims, 11 Drawing Figures

FRICTION CLIP FOR MERCHANDISE DISPLAY HOOKS AND THE LIKE

RELATED APPLICATIONS

This application is a continuation-in-part of applicant's co-pending application Ser. No. 255,717, filed Apr. 20, 1981, now abandoned.

BACKGROUND AND SUMMARY OF THE INVENTION

One of the widely practiced methods of displaying merchandise for sale is to suspend the merchandise on a merchandise hook, sometimes called a pegboard hook, which is appropriately supported by an apertured panel board. Typically, although not necessarily, the merchandise may be packaged on a card, which is in turn suspended on the merchandise hook. It is desirable at times to provide for the positioning of the merchandise on a particular area of the hook, or for the retention of the merchandise on the hook during shipment, or for the marking of a certain segment of the merchandise as a restocking signal. For any of these purposes, and for others not mentioned, it may be desired to apply a retention element or marker on the wire. The Girouard U.S. Pat. No. 2,626,061, for example, illustrates the application of a small frictionally held washer over the outer end of the merchandise hook, in order to prevent accidental removal of merchandise from the display hook. It is also known to provide such washers with a radial slit, to enable the washer to be engaged with the wire behind the merchandise, without first removing the merchandise. U.S. Pat. No. 4,217,986 illustrates a special form of such washer, in which the washer has a distinct horseshoe-shaped configuration, rather than a circular form. The horseshoe-shaped configuration provides an open-sided recess for applying the horseshoe-shaped washer to the merchandise wire. The Collier U.S. Pat. No. 1,868,726 and the See U.S. Pat. No. 3,204,313 illustrate representative forms of resilient clip devices. The Isreeli U.S. Pat. No. 3,353,567 illustrates the use of a clip formed of extruded, resilient material having a Y-shaped cross section, for application over a section of tubing.

In accordance with the present invention, a new and improved form of friction clip is provided, suitable for attachment to a merchandise hook or other wire element, for marking, positioning, retaining, supporting or other purposes. As a uniquely advantageous feature, the friction clip element is provided with a radial slit or other opening, forming an access way to a central wire-gripping aperture. On the opposite side of the clip from the radial slit or opening, there are provided a pair of spaced, integral manipulating tabs which extend from the periphery of the clip a sufficient distance to be engaged by the thumb and finger of the display attendant. When the clip is gripped and squeezed by the tabs, the resilient clip is partially compressed in the area opposite the radial slit, forcing the slit partly open. The arrangement is such that, when the tabs are squeezed, the width of the slit opening, adjacent the outer periphery of the clip, is approximately as wide as, and preferably slightly wider, than the diameter of the wire. The clip may thus be easily applied over the wire and pushed radially to seat the wire within the central aperture. The design of the clip is such, however, that even with the tabs pressed together the width of the slit at the entrance to the central aperture is less than the diameter of the wire, so that the clip has to be pushed firmly onto the wire, in order to seat the wire properly in the aperture. Thereafter, when the tabs are squeezed again, the clip does not open wide enough to release the wire in the absence of the application of additional force for that purpose.

The improved friction clip of the invention, while being capable of economical mass production, greatly facilitates the task of applying the clips to merchandise hooks or other wire elements in the first instance, and also the subsequent positional adjustment of such clips.

Where appropriate, the friction clip of the invention may be manufactured by extrusion of the resilient material in continuous lengths, with the individual clips being severed in appropriate length segments. More desirably, however, the clips are designed to be produced by molding in multiple cavity, automated molds, providing greater control over manufacturing tolerances and also providing for greater flexibility in the configuration and cross section of the clip itself.

For a more complete understanding of the above and other features and advantages of the invention, reference should be made to the following detailed description of preferred embodiments of the invention, and to the accompanying drawing.

DESCRIPTION OF PREFERRED EMBODIMENTS OF THE INVENTION

Figure 1:
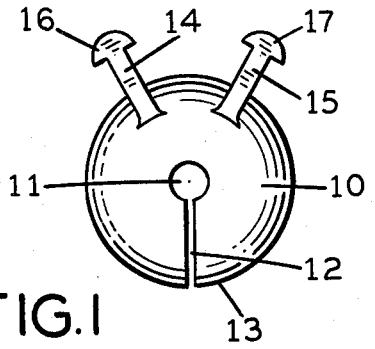
FIG. 1 is a front elevational view of a friction clip device incorporating the features of the invention.

Referring now to the drawing, and initially to FIGS. 1–4 thereof, the reference numeral 10 designates the body of a washer-like friction clip according to the invention. The clip may be of generally circular configuration, as shown, or, in general, of any other appropriate configuration. The clip body 10 is provided with a central aperture 11, which is of a diameter slightly less than the diameter of a wire W (FIG. 4), on which the friction clip is to be mounted. A radial slot 12 extends from the outer periphery 13 of the clip body, radially inward to the central aperture 11, providing a radial passageway whose normal width is substantially less than the diameter of the central aperture. In the first illustrated and preferred form of the invention, the friction clip is intended to be of molded construction, of a suitable moldable elastomeric material, in which case the mold cavity is provided with a thin, radially disposed plate to form a slot 12, which is as narrow as practicable.

Figure 4:
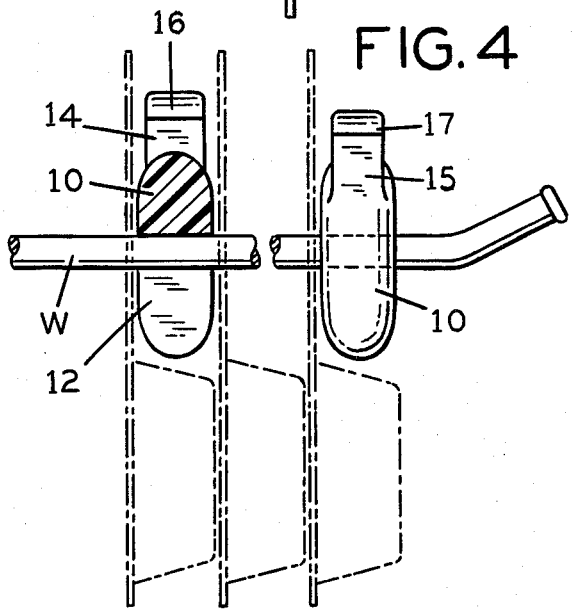
FIG. 4 is a cross sectional view, as taken generally along line 4—4 of FIG. 3, illustrating the cross sectional configuration of the new friction clip element and showing typical uses of the clips.

As illustrated in FIG. 4, the body 10 of the clip conveniently may have a more or less elliptical cross sectional configuration, providing maximum cross sectional width in the center area, for increased contact area with the wire, and reduced cross sectional area toward the periphery for economy of material and improved appearance. In a typical practical embodiment of the invention, the axial length of the clip, measured at the central aperture 11, may be on the order of eight to ten millimeters. The diameter of the clip may for example be on the order of fifteen to twenty millimeters.

In accordance with an important aspect of the invention, the clip body 10 is provided on the side opposite the radial slot 12 with a pair of radially projecting manipulating tabs 14, 15, which extend radially beyond the periphery of the clip a short distance, say, about eight millimeters. These manipulating tabs desirably are provided with beaded or flanged outer extemities 16, 17 to facilitate gripping by the fingers of a user.

Figure 2:
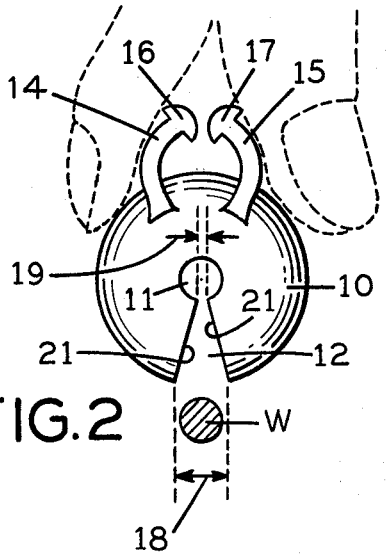
FIG. 2 is a front elevational view of the friction clip element of FIG. 1, illustrated with the manipulating tabs pressed together for opening of the access slit.

Pursuant to the invention, the strength and flexibility of the manipulating tabs 14, 15 is such, in relation to the resilience and flexibility of the clip body 10 that, when the manipulating tabs are gripped by the fingers and squeezed together, as shown in FIG. 2, the radial slot 12 will open. As shown in FIG. 2, the slot enlarges to a sufficient extent that the width of the slot at the periphery of the clip body 10, reflected by the dimension 18, is at least about equal to the diameter of the wire W, and preferably slightly greater, to facilitate the easy application of the clip body onto the wire. At the same time, the width of the slot 12 at the center aperture 11, as reflected by the dimension 19 in FIG. 2, is substantially less than the diameter of the wire W. Accordingly, to apply the clip to the wire, the manipulating tabs 14, 15 are squeezed together, and the clip is forced radially over the wire. As the wire enters the open slot 12, it acts as a wedge and forces apart the surfaces 20, 21 until the wire is received in the central aperture.

As is evident in FIG. 2, when the manipulating tabs 14, 15 are pressed together substantially as far as practicable, the opening dimension 19 into the central aperture is considerably less than the diameter of the wire. Accordingly, while the clip may easily be pressed onto the wire, by a combined squeezing and pressing action of the fingers, removal of the clip from the wire generally and desirably requires additional force and manipulation to be applied, in order to extricate the wire from the aperture 11. This is a desirably feature, in that it inhibits unintended or unauthorized removal of the clip. On the other hand, squeezing together of the manipulating tabs as shown in FIG. 2, desirably releases the frictional grip of the clip on the wire, so that the wire may easily be adjusted axially along the wire if desired. It is of course not necessary to squeeze the tabs 14 and 15 in order to axially adjust the clip on the wire. However, it is a feature of considerable convenience to the user.

Figure 3:
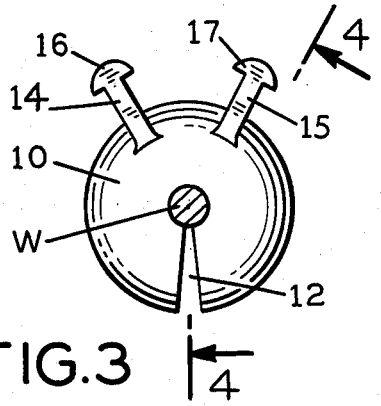
FIG. 3 is a front plan view similar to FIG. 1, illustrating the clip as applied on a merchandise hook or other wire element.

The clip of FIG. 1 is shown in its installed condition in FIG. 3, where it is evident that the radial slot 12 remains in a slightly opened condition after application of the clip to the wire. This is the result of the slight undersizing of the central aperture 11 to provide a desired level of frictional gripping of the wire.

Figure 5:
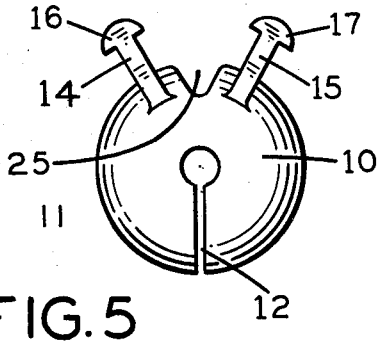
FIG. 5 is a front elevational view of a slightly modified form of the friction clip of FIG. 1.

If necessary or desirable, the upper portions of the clip body, in the region directly opposite the radial slot 12, may be weakened to facilitate hinge-like opening of the clip for application and removal. In the embodiment of FIG. 5, the upper portion of the clip body is provided with a notch 25 for this purpose, which reduces the cross sectional area of the clip body directly opposite the slot 12 and accommodates easier hinging action. Similar results may be obtained by reducing the thickness of the clip body in the axial dimension in the area above the central aperture 11 to achieve the desired degree of resilient and compressibility of the clip in that area for proper hinging action.

Figure 6:
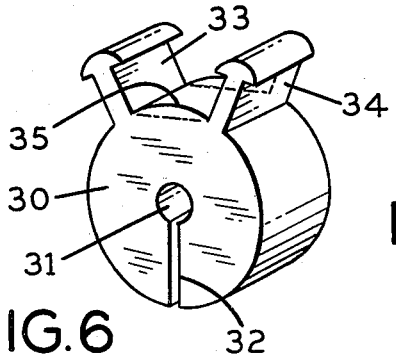
FIG. 6 is a perspective view of a further modified form of the friction clip of the invention, as manufactured by extrusion processes.

In the embodiment of FIG. 6, the friction clip is formed by continuous extrusion of resilient material through an appropriately shaped die, providing a, clip in the form of a slit washer or other appropriate shape. In the case of the embodiment of FIG. 6, unlike the embodiments of FIGS. 1–5, the clip necessarily is of uniform cross section from end to end by reason of the technique of production. The general overall configuration, however, may be similar to the clips of FIGS. 1–5. In the specific illustration of FIG. 6, the body 30 is generally circular in form, provided with a central aperture 31 and a radial slot 32 connecting the aperture with the outer periphery of the clip. Opposite the slot 32, there are provided radially extending manipulating tabs 33, 34, which can be squeezed together to hinge open the slot 32 for easy application of the clip to a section of wire.

Where necessary or desirable to facilitate the hinging action of the clip, the upper portion of the clip body may be weakened, as by notching in the manner of FIG. 5, for example, or by eliminating in the extrusion process an upper chordal area 35 of the clip body. In the embodiment of FIG. 6, however, it is not practicable to weaken the hinge area of the clip by reducing the front-to-back thickness of the clip in the area of the hinge. Generally, because of the extruded construction of the unit in FIG. 6, it is necessary in a practical production process, to extrude the shape in more or less continuous lengths and then slice the continuous lengths into short segments having parallel front and back faces. It is a simple matter, on the other hand, to weaken the hinge area to any necessary extent by shaping the extrusion die to provide an appropriate notch or recess in the upper portion of the clip body.

Figure 8:
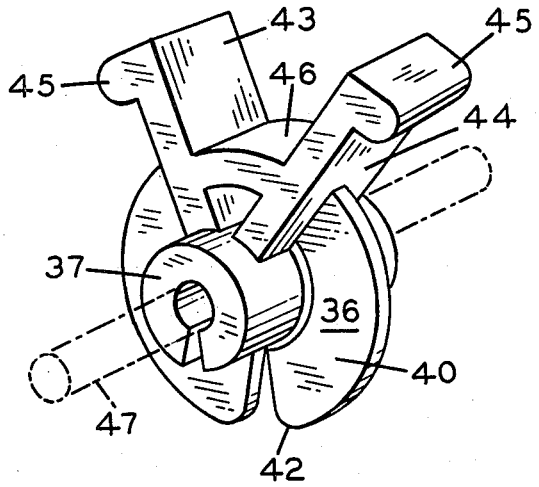
FIG. 8 is a perspective view of a further improved form of the friction clip of the invention in an advantageous form of molded construction.
Figure 10:
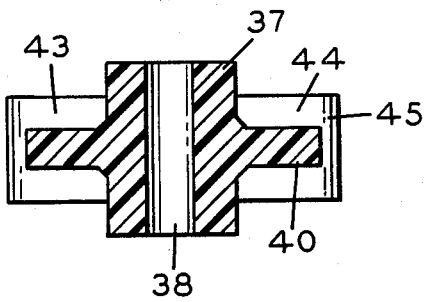
FIGS. 10 and 11 are cross sectional views of the friction clip of FIG. 8, taken generally along lines 10—10, 11—11 respectively of FIG. 9.
Figure 9:
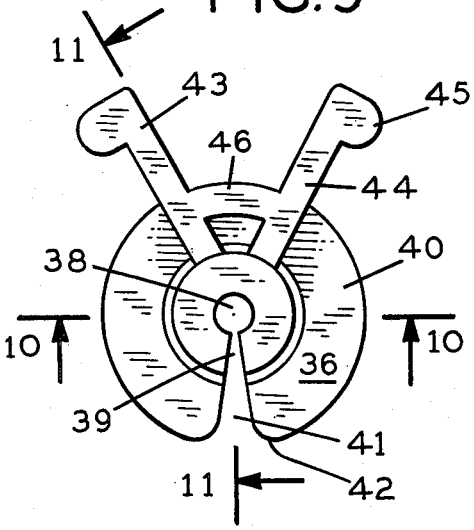
FIG. 9 is a front elevational view of the friction clip of FIG. 8.
Figure 11:
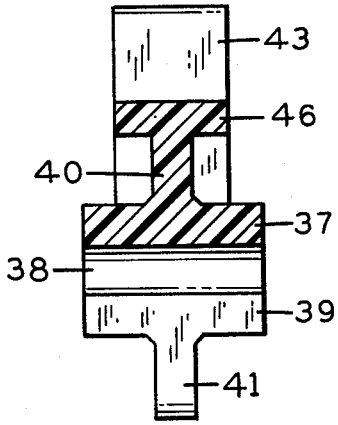

FIGS. 8–10 illustrate a particularly advantageous form of the invention, designed to be produced by high production, low cost molding techniques. The clip 36 includes an elongated, generally cylindrical sleeve 37 provided with a central opening 38 extending from one end to the other and an open slot 39 extending along the bottom of the sleeve for its full length. In an advantageous commercial embodiment, the clip is molded of a flexible polyvinyl chloride material having a durometer of approximately 56 and a specific gravity of approximately 1.555. This is, of course, intended to be illustrative only, as other resilient, moldable materials of construction may be utilized.

Surrounding the elongated sleeve 37, approximately in the center thereof is a generally circular reinforcing web 40, which is provided in its lower portion with a slot 41 forming a continuation of the slot 39 in the central sleeve. As will be observed particularly in FIG. 9, the slot structure 39, 41 is divergent from the central opening 38 to the outer periphery of the circular, disc-like web 40, with the outer portions of the web slot being rounded at 42.

In the upper portion of the clip 36, directly opposite the slot 39, 41 are a pair of manipulating tabs 43, 44, which extend radially outward from the sleeve 37, more or less in straddling relation to the disc-like web 40. In the illustrated embodiment, the respective tabs 43, 44 are angularly spaced about 60° apart and extend for a distance of about 0.30" from the outer surface of the sleeve 37. To advantage, each of the manipulating tabs 43, 44 is provided with a finger gripping rib 45, each facing outwardly with respect to the other so as to facilitate gripping and squeezing together of the tabs by the fingers.

In the illustrated form of the invention, the axial dimension of the tabs 43, 44 is advantageously somewhat less than the length of the sleeve 37, yet greater than the axial dimension of the disc-like web 40. In a typical case, without implying limitation, the axial dimension of the sleeve 37 may be on the order of 0.375", that of the tabs 43, 44 may be approximately 0.250" and that of the web 40 may be approximately 0.100".

An integral flange-like reinforcing rib 46 extends between the manipulating tabs 43, 44 in the region of the outer periphery of the web 40. The reinforcing rib serves to resist squeezing together of the tabs 43, 44 to a desired extent, and to impart additional restoring resilience when the tabs are released, so that the sleeve 37 firmly grips a wire 47 on which it is placed and adequately resists accidental or unauthorized removal.

With a device of the character shown in FIGS. 8–11, a single clip will adequately grip wire sizes ranging from 0.130" to 0.187", which represents the vast majority of wire sizes used in merchandising displays. For this application, the central sleeve opening 38 may be about 0.110", the sleeve outer diameter may on the order of 0.312" and the web outer diameter may be on the order of 0.687". The slot structure 39, 41, may have a 10° included angle of divergence and a width diaension at the narrowest point (immediately adjacent the central opening 38) of about 0.020".

The use and operation of the device of FIGS. 8–11 is basically similar to that illustrated in FIG. 2. When the manipulating tabs 43, 44 are squeezed together, the slot 39, 41 opens somewhat to accommodate radial application of the clip over the wire 47, although the narrowest part of the slot 39 is still of substantially smaller dimension than the diameter of the wire to which the device is applied. When the tabs are released, the resilience of the material, augmented by the action of the rib 46 and the disc-like web 40 serves to close the sleeve tightly about the wire with a non-sliding grib. The clip may be easily adjusted axially along the wire by squeezing together the manipulating tabs 43, 44. In order to remove the device from the wire, however, it is necessary to impart a substantial pulling force, even though the manipulating tabs are squeezed together.

With a device of the character shown in FIGS. 8–11, a single clip will adequately grip wire sizes ranging from 0.130" to 0.187", which represents the vast majority of wire sizes used in merchandising displays. For this application, the central sleeve opening 38 may be about 0.110", the sleeve outer diameter may on the order of 0.312" and the web outer diameter may be on the order of 0.687". The slot structure 39, 41, may have a 10° included angle of divergence and a width dimension at the narrowest point (immediately adjacent the central opening 38) of about 0.020".

The use and operation of the device of FIGS. 8–11 is basically similar to that illustrated in FIG. 2. When manipulating tabs 43, 44 are squeezed together, the slot 39, 41 opens somewhat to accommodate radial application of the clip over the wire 47, although the narrowest part of the slot 39 is still of substantially smaller dimension than the diameter of the wire to which the device is applied. When the tabs are released, the resilience of the material, augmented by the action of the rib 46 and the disc-like web 40 serves to close the sleeve tightly about the wire with a non-sliding grib. The clip may be easily adjusted axially along the wire by squeezing together the manipulatig tabs 43, 44. In order to remove the device from the wire, however, it is necessary to impart a substantial pulling force, even though the manipulating tabs are squeezed together.

The device of the invention is useful in a variety of ways in connection with the display of hook-supported merchandise and otherwise. A common use is as a back limit for the merchandise, to keep the merchandise positioned toward the front of a hook, where the hook is considerably longer than is required to display a given quantity of the merchandise. A clip may also be placed on the hook in front of the merchandise, to prevent the merchandise from falling off the hook during shipment. This is particularly desirable in connection with displays which are assembled and preloaded by the rack jobber and shipped in loaded condition to the merchandiser. After the display has been unpacked and set up on the floor, the retaining clips can be removed to make the merchandise readily accessible. It may also be desirable in certain cases to insert a friction clip on the hook at an appropriate place in a series of merchandise cards, to act as an inventory control reminder. Thus, after a certain number of packages have been removed, the clip will be exposed and the store clerk will know to restock the hook.

Figure 7:
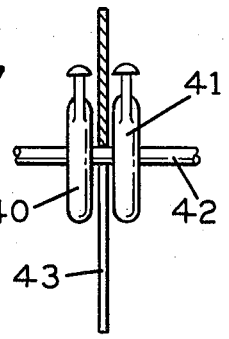
FIG. 7 is an illustration of a further manner in which the new clip can be used.

Another advantageous application for the friction clip is in connection with adjustable, wire supported divider plates for merchandising bins or the like, which require frequent positional adjustment. As reflected in FIG. 7, a pair of friction clips 40, 41 may be installed on a wire 42, on opposite sides of a dividing plate 43. When it is desired to reposition the dividing plate 43 along the wire support, the friction clips 40, 41 can be quickly removed and/or repositioned axially to accommodate the adjustment.

In any of the forms of the invention, it is contemplated that the clips can be manufactured in various sizes, as necessary, to fit standard wire gages. Primarily, this involves adjustment of the size of the central aperture 11, and typically several wire sizes could be accommodated in a clip body of a common size. For convenience of distinguishing aperture sizes, the clip bodies may be molded or extruded of distinctively colored materials for each of the different sizes.

It shoud be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A friction clip for use in conjunction with a wire-like element, such as a merchandise supporting hook or the like, formed of a unitary molding of resilient, plastic material and comprising (a) a tubular sleeve-like clip body having a central opening, and a predetermined axial length substantially greater than the diameter of said opening, (b) said central opening having a predetermined diameter such that the clip body is adapted to frictionally grip the wire-like element when the element is disposed inside the central opening of said clip body, (c) a disc-like flange integral with and concentrically surrounding the central portion of said sleeve-like body, (d) said flange having an axial length substantially less than that of said sleeve-like body and being generally centrally positioned with respect thereto, (e) a radial slot in said sleeve-like clip body and flange extending from said central aperture to the outer periphery of said flange, (f) a pair of manipulating tabs integral with the clip body extending outwardly therefrom and being generally symmetrical with respect to said radial slot, on the opposite side of said opening therefrom, (g) said manipulating tabs having a width less than the length of said sleeve-like clip body and greater than that of said flange and being highly flexible in relation to said clip body, (h) said tabs having oppositely facing gripping projections at their outer extremities to facilitate fingertip manipulation, (i) said tabs being adapted when pressed toward each other to cause the opposed surface of said radial slot to move apart, enlarging the slot in such a manner that the width of the outer end of the slot is not substantially less than the diameter of the wire while the inner end of the slot is narrower than the diameter of the wire.

2. A friction clip according to claim 1, further characterized by (a) an integrally formed reinforcing rib extending between said tabs along the outer periphery of said flange, opposed to said slot, said rib having a width greater than the width of said flange.

* * * * *